US005540121A

United States Patent [19]

Helmers

[11] Patent Number: 5,540,121

[45] Date of Patent: Jul. 30, 1996

[54] DOOR OPENING TOOL

[76] Inventor: Kevin D. Helmers, 3410 Willie Way, Spring, Tex. 77380

[21] Appl. No.: 378,182

[22] Filed: Jan. 25, 1995

[51] Int. Cl.[6] ..... B25B 33/00

[52] U.S. Cl. ..... 81/15.9

[58] Field of Search ..... 81/15.9, 488, 64, 81/3.4; 70/465; 294/19.1

[56] References Cited

U.S. PATENT DOCUMENTS 4,876,927 10/1989 Mullen ..... 81/15.9

OTHER PUBLICATIONS

Phillips, Bill, *Professional Locksmithing Techniques,* 1991, Chapter 10, pp. 123–132.

Keedex, *Lever Opening Tool,* as referenced in the Acme Wholesale Distributors, Inc. catalog, 1992, p. 205.

*Primary Examiner*—D. S. Meislin

*Attorney, Agent, or Firm*—Vaden, Eickenroht & Thompson, L.L.P.

[57] ABSTRACT

A tool for use in opening a locked door from its outer side by means of a rotatable doorknob on the inner side of the door is provided. The tool comprises an arm having a cup rotatably carried thereby and a handle manipulable from the outer side of the door. The cup is collapsible to permit it to pass with the arm under the door, but is normally expanded to a shape enabling it to fit over the doorknob. When the cup is passed with the arm beneath the door, the arm and the cup may be rotated by the handle to a position in which the open side of the cup is opposite the doorknob and then drawn back by the handle toward the inner side of the door to permit the cup to fit over the doorknob. Means are attached to the cup that is operable from the outer side of the door to cause the cup to grip and then rotate the doorknob to permit the door to be opened.

5 Claims, 2 Drawing Sheets

DOOR OPENING TOOL

BACKGROUND OF THE INVENTION

The present invention relates to locksmith tools for opening locked doors. More particularly, the present invention relates to tools for opening doors, such as those doors typically found in office buildings, having an "outer" doorknob that is locked to prevent access from the outer side of the door, and an "inner" doorknob that always turns freely to open the door from the inner side thereof.

These types of doorknob lock mechanisms are designed, among other reasons, to comply with building codes requiring that persons inside an office suite, for example, always have a quick manner of egress in case of an emergency. However, this type of lock mechanism also creates the possibility of locking individuals outside of their offices, or perhaps a particular room in their home, without a key to get back in. Several solutions to this reoccurring problem have been proposed and utilized.

Among these solutions is hiring a locksmith to pick, and/or drill the locking mechanism in the doorknob. Lock picking requires a great deal of practice, and knowledge of lock cylinders, and may take considerable time to be successful. The process may involve a manual pick, or a pick "gun." The primary problem with this method is that the improper use of a picking device can cause internal damage to the lock, thereby preventing further picking or even opening of the door with the correct key. Other difficulties include the use of specially shaped anti-pick driver pins in lock cylinders to hamper lock picking.

Another method of entry employs an electric drill to drill out the shear line, bottom pins, or top pins of the lock so that the lock's cylinder plug will turn and enable the locked door to be opened. The obvious downside of drilling the lock is that it destroys the lock cylinder and plug assembly, and could damage the other parts of the lock as well.

If the locked door is positioned underneath a false, suspended ceiling such as the type with removable tiles that extends over both sides of the door, then a locksmith or other person may gain access to the inner side of the door by climbing over it. This requires that there be no security barrier above the door, and further requires a method of ascent and a safe means of descent from above the door, typically from a height of approximately 12 feet. This method is considered unsafe for obvious reasons.

A tool has been developed by the Keydex Company for use with doors having "lever" type handles rather than the common "knob" type. The tool includes a semi-rigid arm that is inserted underneath the locked door from the outer side thereof for hooking the door lever on the inner side. The tool is pulled from the outer side of the door to draw the hooked portion of the tool downward. The downward motion of the hooked portion induces rotation of the inner door lever and thereby open the locked door. A cable attached to the hooked portion of the tool may also be pulled from the outer side of the door to assist in rotating the door lever. The problem with this type of tool is the limitation that it be used only on doors having lever type handles. The tool is unable to induce rotation of a doorknob, and therefore unable to open any door having doorknobs.

In response to the problems described above, it is an object of the present invention to provide a tool that is nondestructive, safe, and simple to operate, for opening a door having a freely turning inner doorknob from a locked outer side thereof.

SUMMARY OF THE INVENTION

This and other objects are achieved, in accordance with the illustrated embodiments of the present invention, by a tool for use in opening a locked door from its outer side by means of a rotatable doorknob on the inner side of the door. The tool comprises an arm having a cup rotatably carried thereby and a handle manipulable from the outer side of the door.

The cup is collapsible to permit it to pass with the arm under the door, but is normally expanded to a shape to fit over the doorknob. When the cup is passed with the arm beneath the door, the arm and the cup may be rotated by the handle to a position in which the open side of the cup is opposite the doorknob. The arm and the cup are then drawn back by the handle toward the inner side of the door to permit the cup to fit over the doorknob.

Means are attached to the cup and operable from the outer side of the door to cause the cup to grip and then rotate the doorknob to permit the door to be opened.

In the preferred embodiment of the present invention, the gripping and rotating means comprises a first VELCRO® strip peripherally carried about the exterior of the cup, a second VELCRO® strip removably fastened to the first VELCRO® strip, and a cord connected to the second VELCRO® strip and having an end extending therefrom. The cord has a length such that the end thereof can remain on the outer side of the door when the cup is passed beneath the door and rotated with the arm by the handle to engage the doorknob on the inner side of the door. The end of the cord may be pulled to unfasten the second VELCRO® strip from the first VELCRO® strip causing the cup to grip and then rotate the doorknob on the inner side of the door.

DETAILED DESCRIPTION OF THE PREFERRED EMBODIMENT

Figure 1:
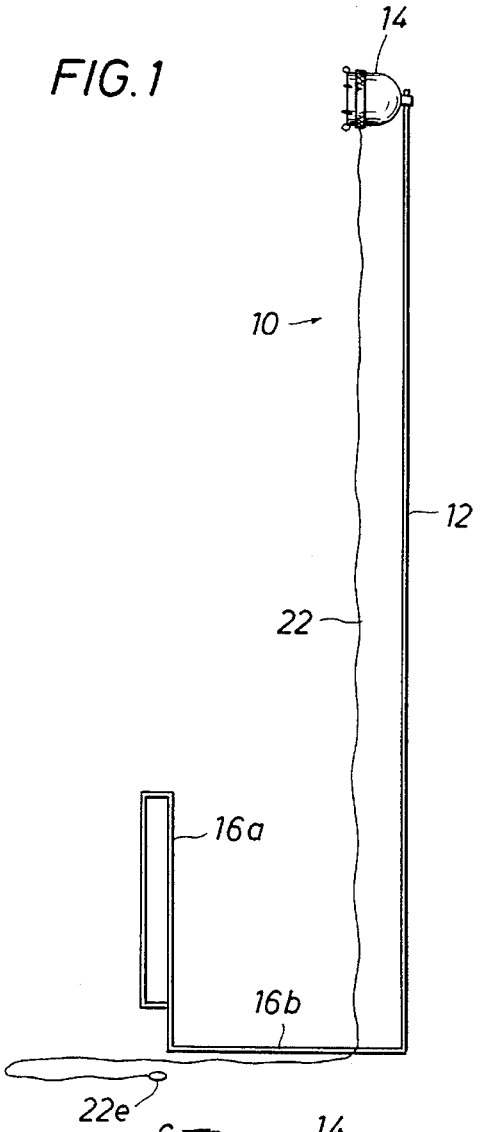
FIG. 1 is an elevational view of a door opening tool in accordance with the present invention.
Figure 10:
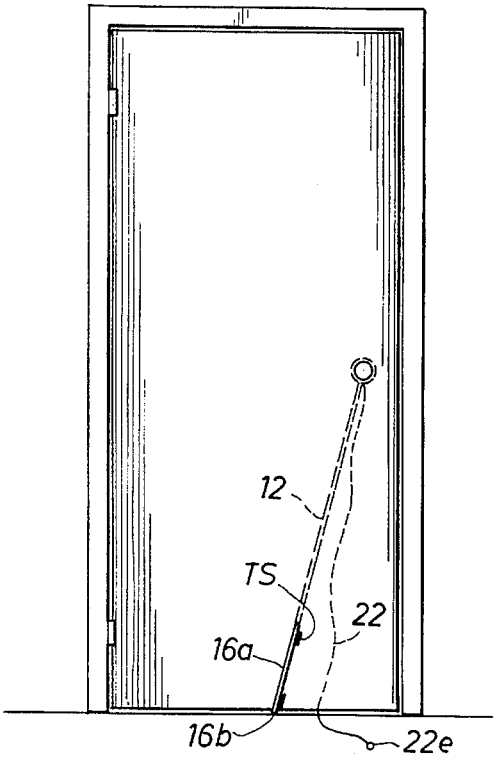
FIG. 10 is an elevational view of the door opening tool showing the cup and arm in hidden lines as rotated on the inner side of the door by the gripping portion of the handle from the position of FIG. 9.
Figure 11:
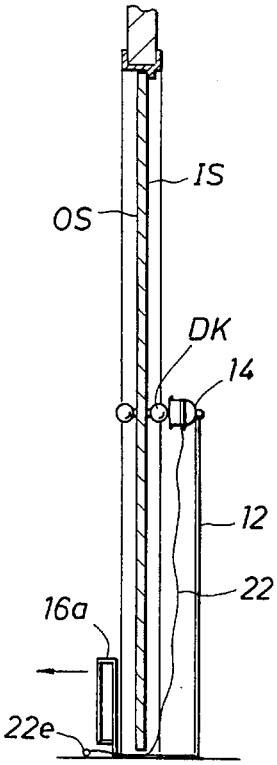
FIG. 11 is a sectional view of the door showing the flexible cup of the door opening tool positioned for engagement with the inner doorknob.
Figure 12:
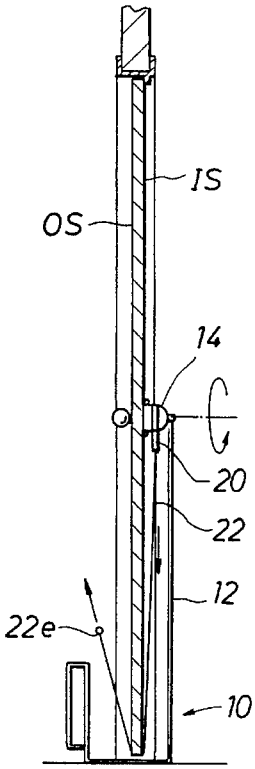
FIG. 12 is a sectional view of the door showing the cup of the door opening tool gripping and rotating the doorknob.

The preferred embodiment of a tool 10 for opening a locked door having a rotatable doorknob DK on its inner side IS, shown in FIG. 1 comprises a semi-rigid longitudinal arm 12 that is adapted for passage beneath the door from its outer side OS to its inner side IS. Arm 12 is of a length for extending from a floor underneath the door to a doorknob DK on the inner side IS of the door, as is shown in FIGS. 10–12, and in a manner to be described below.

Figure 8:
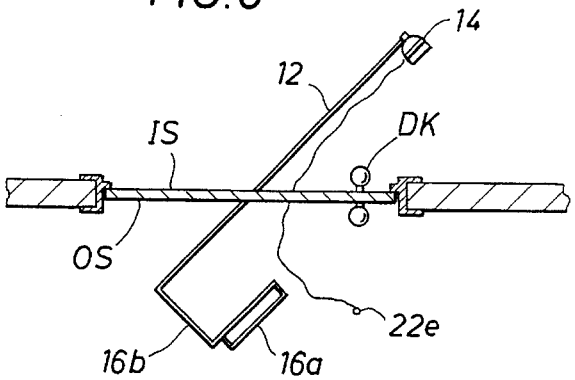
FIG. 8 is a plan view of the door opening tool positioned underneath a door by the handle.

A cup 14 is rotatably carried by the arm for gripping and rotating doorknob DK. Cup 14 is collapsible to permit it to pass with arm 12 beneath the door to the inner side IS thereof, as shown in FIG. 8, but is normally expanded in a semispherical shape so as to fit over a doorknob. Cup 14 is formed of a material, preferably rubber or a latex compound, having a sufficient coefficient of friction to transfer torque from the cup to a doorknob. The cup can be compressed, e.g., within a common two-flap folder enabling it to be easily slid on a carpeted floor beneath the door. Upon passage to the inner side IS of the door, the cup will return to its original expanded shape.

Figure 2:
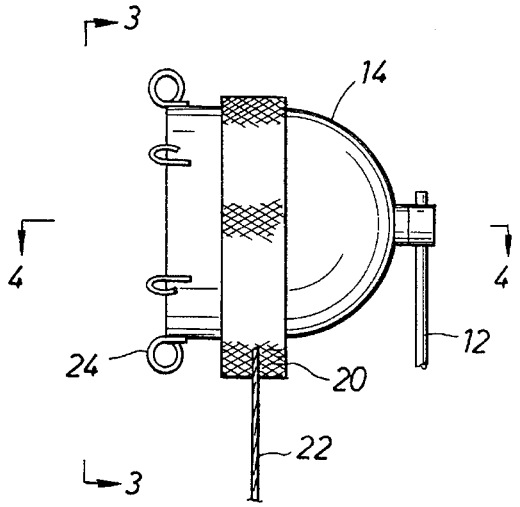
FIG. 2 is a detailed view of a doorknob-engaging flexible cup of the door opening tool.
Figure 4:
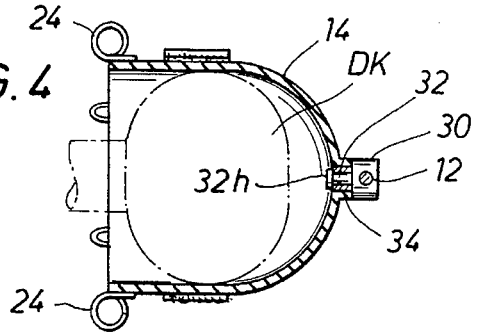
FIG. 4 is a sectional view of the flexible cup taken along the section line 4—4 shown in FIG. 2.

As shown in FIGS. 2 and 4, cup 14 is rotatably attached to arm 12 by way of a housing 30 mounted on the arm. Pin 32 is mounted perpendicularly in housing 30 with respect to arm 12. Sleeve 34 is attached to cup 14 and is rotatable about pin 32, enabling cup 14 to rotate with respect to housing 30 and arm 12. Head **32*h* of pin 32 retains sleeve 34 and cup 14 in close proximity with housing 30**.

Handle 16 of tool 10 comprises gripping portion **16*a* connected to one end of arm 12 by base portion 16*b* for positioning cup 14 in engagement with doorknob DK. Base portion 16*b* is flat and connected perpendicularly to arm 12 for reasons that will be explained below. Gripping portion 16*a* remains on the outer side OS of the door when cup 14 and arm 12 are slid under the door. This enables the operator on the outer side to manipulate arm 12 and cup 14 to position cup 14** for engagement with doorknob DK on the inner side IS of the door.

Figure 7:
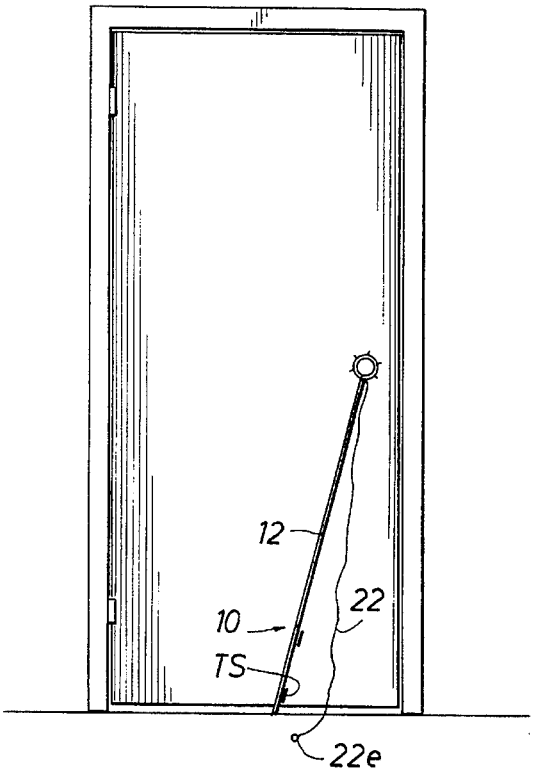
FIG. 7 is an elevational view of the door opening tool shown in a reference-marking position on the outer side of a door.

Before inserting arm 12 and cup 14 of door opening tool 10 beneath the door, an operator on the outer side OS of the door must determine the proper placement angle of arm 12 formed between the arm and the floor when cup 12 engages the doorknob on the outer side OS of the door. The operator can then mark the angle as a reference, for placement of cup 14 on doorknob DK on the inner side IS, with strips of tape TS as is displayed in FIG. 7. Thus, arm 12 is capable of extending to doorknobs mounted in a door at various heights from the floor and various horizontal distances from the edge of the door. The angle made by the arm and the floor is simply adjusted as appropriate.

Figure 9:
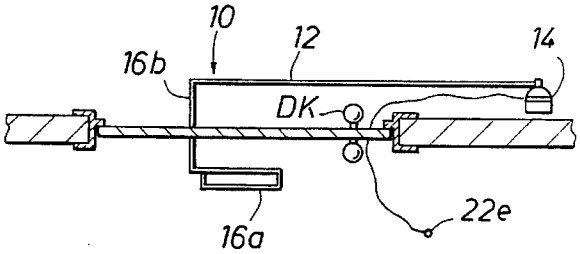
FIG. 9 is a plan view of the door opening tool oriented parallel to the door by the gripping portion of the handle for positioning the flexible cup in engagement with the inner doorknob.

Once the reference angle is marked, cup 14 and arm 12 are passed beneath the door using handle 16. Handle base portion **16*b* is then oriented substantially perpendicularly to the door, as shown sequentially in FIGS. 8 and 9. With reference to FIG. 10, gripping handle portion 16*a* can then be rotated using base portion 16*b* lying on the floor as a pivot. The flat shape of portion 16*b* facilitates its frictional contact with the floor and the rotation of gripping portion 16*a* relative to the floor. Gripping portion 16*a* is rotated until it is aligned with tape strips TS, thereby rotating arm 12 and positioning cup 14** in the vicinity of doorknob DK on the inner side IS of the door.

At this point, cup 14 is moved into engagement with doorknob DK by sliding portion **16*b* along the floor with respect to the door using gripping handle portion 16*a* to pull arm 12 and cup 14 towards the inner side IS, as shown in FIG. 11. The engagement of cup 14 with doorknob DK will be sensed by the sound of eyelets 24 mounted to cup 14 as the eyelets contact the doorknob. The cylindrical shape of eyelets 24 and their orientation about the open end of cup 14 assists in guiding cup 14 onto and about doorknob DK as gripping handle portion 16*a*** is pulled along the floor by the operator on the outer side OS of the door.

Figure 3:
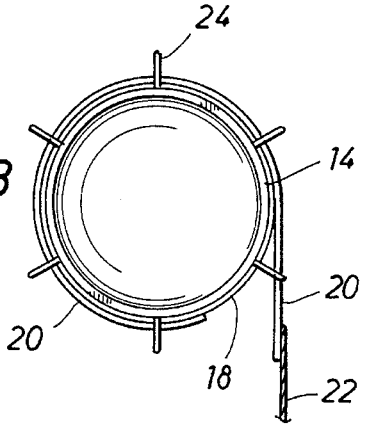
FIG. 3 is an end view of the flexible cup shown in FIG. 2.

Means are attached to cup 14 for gripping and rotating doorknob DK once the cup has been fitted about the doorknob. As shown more particularly in FIGS. 2 and 3, the gripping and rotating means comprises a first VELCRO® strip 18 peripherally carried about the exterior of cup 14, a second VELCRO® strip 20 removably fastened to first strip 18, and a cord 22 connected to second VELCRO® strip 20 and having an end **22*e* extending therefrom. With reference to FIG. 11, cord 22 has a length such that end 22*e* remains on the outer side OS of the door when arm 12 and cup 14 are passed beneath the door and rotated to position the cup in engagement with doorknob DK on the inner side IS of the door. End 22*e* of cord 22 is then pulled by an operator on the outer side OS of the door, illustrated by the line of action arrow in FIG. 12, to progressively unfasten second strip 20 from first strip 18 causing cup 14** to grip and rotate doorknob DK on the inner side IS of the door.

Figure 5:
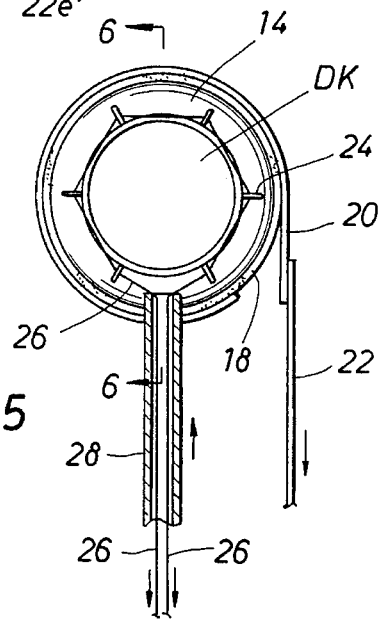
FIG. 5 is a view of the open end of the flexible cup with eyelets drawn inward by a cinch assembly to collapse the cup on the doorknob.
Figure 6:
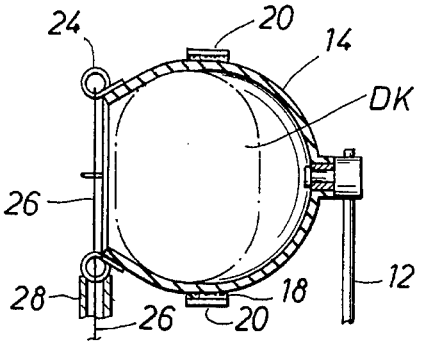
FIG. 6 is a sectional view of the flexible cup taken along the section line 6—6 shown in FIG. 5.

With most doorknobs, simple axial motion of the cup 14 towards doorknob DK will result in sufficient frictional engagement between the cup and the doorknob to enable gripping and rotation of doorknob DK by the operator via the cord 22, second VELCRO® strip 20, and first VELCRO® strip 18. However, certain doorknobs having narrower axial width, and those with odd shapes will require that cup 14 grasp the doorknob more securely to transfer torque from the cup to the doorknob. For this purpose, the door opening tool 10 may be provided with accessory components in the form of cinch cord 26 and flexible tube 28, as shown in FIGS. 5 and 6. Tube 28 is preferably made of plastic or nylon, and has a small diameter. As is apparent from FIG. 5, which shows cup 14 fitted over doorknob DK, the tube must be long enough to be operable from the outer side OS of the door. In other words, tube 28 must reach from doorknob DK to the outer side OS of the door, typically a distance of 50 to 60 inches, along the same general path as cord 22. Cinch cord 26 is threaded through tube 28 and each of the eyelets 24. Both ends of cinch cord 26 remain on the outer side OS of the door when cup 14 and arm 12 are passed beneath the door to enable access to the ends by the operator.

After cup 14 has been successfully positioned on doorknob DK, the operator grasps the ends of the cinch cord 26 in one hand and the end of the tube 28 on the outer side OS of the door in the other hand. The ends of the cinch cord 26 are pulled slowly by the operator as tube 28 is gently pushed beneath the door. This action results in the end of the tube 28 on the inner side IS of the door approaching eyelets 24, and eyelets 24 being drawn in a tight circle closing the open end of cup 14 about doorknob DK, as is displayed more clearly in FIG. 6. Thus, the use of tube 28 and cinch cord 26 provides sufficient frictional engagement between cup 14 and certain irregularly shaped doorknobs DK. A cord lock or spring clip (neither of which is shown) may be attached to cinch cord 26 against the end of tube 28 on the outer side OS of the door by the operator to keep the cinch cord from loosening. Once cinch cord 26 is secured, the door opening tool 10 is used in the manner described above, i.e, by pulling on end 22*e* of cord 22 to grip and rotate doorknob DK, and open the door. It will be appreciated by those skilled in the art that cinch cord 26 and tube 28 are not normally required, and are therefore not normally used in the operation of door opening tool 10.

It will be appreciated by those skilled in the art that door opening tool 10 may be used from a remote location other than the floor on the outer side of the locked door. For example, in the case of a locked door having lift-out ceiling panels on both sides of the door, an operator could operate tool 10 from an elevated position above the door. To facilitate operator from this position, the orientation of cup 14 could be reversed, i.e., turned 180° such that the open end of the cup faced away from the gripping portion 16*a* and handle 16.

From the foregoing it will be seen that this invention is well adapted to attain all the ends and objects herein set forth, together with other advantages which are obvious and inherent to door opening tool 10.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as being illustrative and not in a limiting sense.

What is claimed:

1. For use in opening a locked door from its outer side by means of a rotatable doorknob on the inner side of the door, a tool comprising:

an arm having a handle to permit it to be manipulated from the outer side of the door;

a cup mounted for rotation on the arm remote from the handle and being collapsible to permit the cup to pass with the arm under the door, said cup being normally expanded to a shape to fit over the doorknob, so that, when passed with the arm beneath the door, the arm may be rotated by said handle to a position in which the open side of the cup is opposite the doorknob and then drawn back by said handle toward the inner side of the door to cause the cup to fit over the doorknob; and means attached to the cup and operable from the outer side of the door to cause the cup to grip and then rotate the doorknob to permit the door to be opened.

2. The tool of claim 1 wherein said means to grip and rotate the cup comprises:

a strip secured at a first end thereof to said cup for winding thereabout and being of such length that a second end of said strip can remain with the handle on the outer side of the door when said cup is engaged with the doorknob on the inner side of the door, and means releasably fastening a portion of the strip wound about the cup to permit the portion to unwind and then rotate the doorknob with the cup in response to a pull on its second end.

3. The tool of claim 1, wherein said means to grip and rotate the cup comprises:

a first strip secured about the exterior of said cup;

a second strip wound about the exterior of said first strip, the opposing surfaces of said strips carrying VELCRO® for releasably fastening the strips to one another; and a cord connected to said second strip at a first end of the cord and being of such length that a second end thereof can remain with the handle on the outer side of the door when said cup is engaged with the doorknob on the inner side of the door and then rotate the doorknob with said cup in response to a pull on the second end of said cord.

4. The tool of claim 3, further comprising means on the cup engageable with the inner side of the door to indicate that said cup is positioned to be fitted over the doorknob.

5. The tool of claim 4, further comprising means operable from the outer side of the door for drawing the open end of said cup closely about the doorknob to enhance the ability of said cup to grip the doorknob.

* * * * *